United States Patent [19]

Leith et al.

[11] Patent Number: 4,869,078

[45] Date of Patent: Sep. 26, 1989

[54] EARRING HOLDER

[76] Inventors: Marijana T. Leith; Edwin L. Leith, III, both of 1493 Valley View Dr., Arnold, Mo. 63010

[21] Appl. No.: 238,412

[22] Filed: Aug. 31, 1988

[51] Int. Cl.[4] ..... A44C 7/00

[52] U.S. Cl. ..... 63/13

[58] Field of Search ..... 63/29.1, 23, 13, 12, 63/14.2, 14.8, 14.6; 24/241 P, 241 PP, 241 PL, 241 PS, 241 SP, 241 SB, 239

[56] References Cited

U.S. PATENT DOCUMENTS

| | | | |
|---|---|---|---|
| 319,972 | 6/1885 | Giffard | 24/241 PL |
| 3,116,616 | 1/1964 | Bangs | 63/29.1 X |
| 4,727,883 | 3/1988 | Moody | 63/29.1 X |

FOREIGN PATENT DOCUMENTS

| | | | |
|---|---|---|---|
| 620113 | 10/1935 | Fed. Rep. of Germany | 63/29.1 |

*Primary Examiner*—James R. Brittain

*Attorney, Agent, or Firm*—Michael Kovac

[57] ABSTRACT

An earring holder for interchangeably receiving at least one of a variety of different earring accessories is disclosed. The earring holder includes a body in which a spring loaded earring support is pivotally mounted for movement between an open position for interchangeably mounting at least one earring accessory, and a closed position for releasably securing the earring accessory or accessories to the earring holder. A variety of different types of ear attachment devices may be used in connection with the earring holder, for attaching same to a user's ear lobe.

17 Claims, 1 Drawing Sheet

EARRING HOLDER

BACKGROUND OF THE INVENTION

The present invention relates to earring holders, an more particularly to an earring holder for interchangeably receiving at least one of a variety of different earring accessories.

It is customary for women to change earrings in order to match clothes styles, the time of day, and the function to be attended. As a result, most women have a great variety of types and kinds of earrings which are of different shapes, styles and colors. In addition, earrings have various ear lobe fastening devices including spring clamps and screw clamps which clamp on ear lobes, and post/clutch devices and wire ring devices which extend through pierced ear lobe openings.

As will be appreciated, it is not only difficult to attach earrings to a user's ear lobes, particularly where earrings having different types of ear lobe fastening devices are employed, but it is quite time consuming. Earrings of different types and styles are, therefore, not conveniently interchanged. In some cases, women can only wear precious metal earrings, i.e., gold, silver, etc., because of infections or allergic reactions. This makes it difficult or even impossible for such women to wear various types of costume jewelry, which are typically not made of precious metals. All of the above offers an opportunity for an earring construction which can be interchangeably used with different types and kinds of earring accessories.

SUMMARY OF THE INVENTION

Among the objects and advantages of the present invention may be noted:

the provision of an earring construction which overcomes the aforenoted deficiencies of the prior art;

the provision of an earring holder for interchangeably receiving at least one of a variety of different earring accessories;

the provision of an earring holder which can be made of gold or other precious metals, to overcome infection or allergic reactions to non-precious metals, while at the same time, enabling a variety of different earring accessories made from non-precious metals to be interchangeably mounted relative to the earring holder;

the provision of the aforementioned earring holder which includes an open or mounting position to facilitate interchangeable mounting of various earring accessories, and a closed or locked position for releasably securing each assembled earring accessory to the earring holder;

the provision of the aforementioned earring holder, in which at least one earring accessory is quickly and easily mounted relative to the earring holder, and then is securely locked and retained with respect thereto; and the provision of the aforementioned earring holder which is simple and easy to operate, is capable of being manufactured without difficulty, is economical, is durable and long lasting, and is otherwise well adapted for the purposes intended.

These and other objects of the present invention will become more apparent from the ensuing description.

BRIEF DESCRIPTION OF THE DRAWINGS

In the drawings

Corresponding reference numerals will be used throughout the various figures of the drawing.

DESCRIPTION OF THE PREFERRED EMBODIMENT

Figure 1:
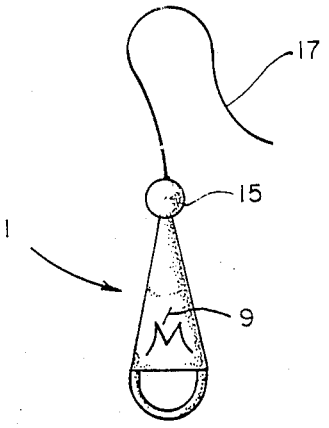
FIG. 1 is a front elevational view of an earring holder, for interchangeably receiving at least one of a variety of different earring accessories, that is constructed in accordance with of the present invention.
Figure 2:
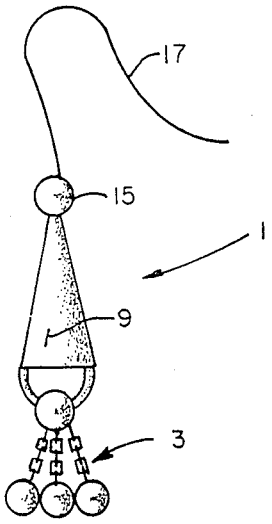
FIG. 2 is a front elevational view of the earring holder shown in FIG. 1 with one type of earring accessory mounted with respect thereto.
Figure 3:
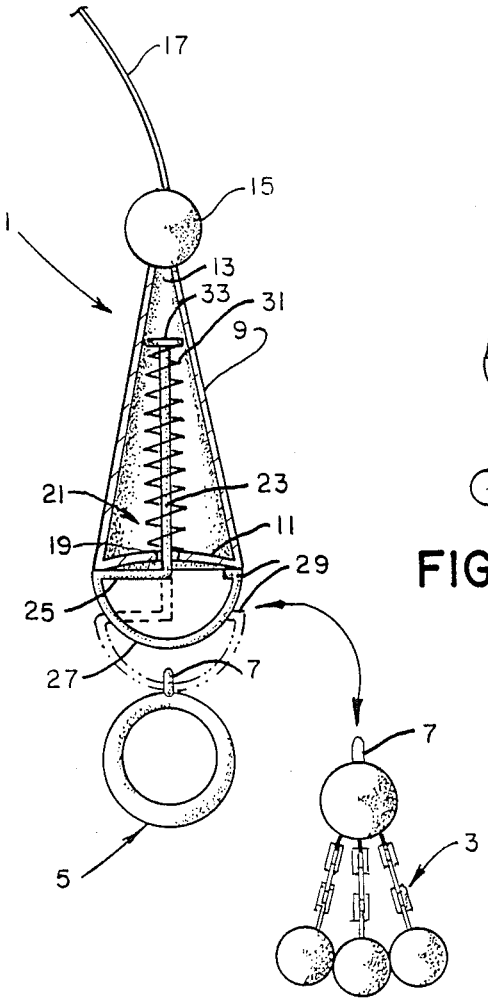
FIG. 3 is an enlarged front elevational view, partly in section, illustrating the use of a spring loaded earring support for interchangeably receiving at least one of a variety of different accessories.
Figure 4:
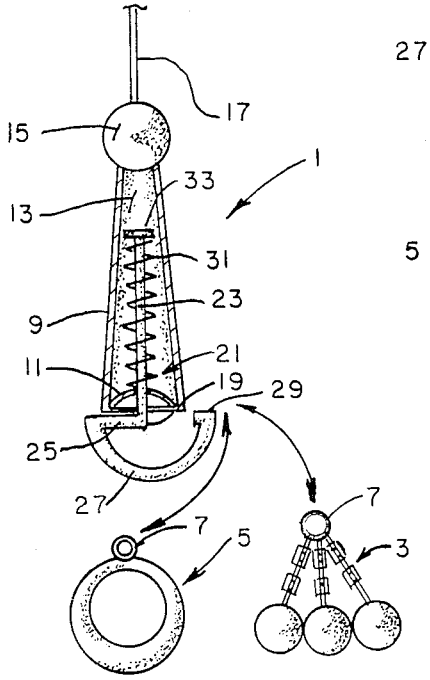
FIG. 4 is an enlarged end elevational view, partly in section, and showing the spring loaded earring support as being moved to an open or mounted position to facilitate the reception of at least one accessory thereon.

As is shown in the drawing, an earring holder 1 is constructed for interchangeably receiving at least one of a variety of different earring accessories. For example, the earring holder 1 shown in the various figures of the drawings may be used with a dangling ball or bead accessory 3 illustrated in FIGS. 2–4 of the drawings, an earring accessory ring 5, as shown in FIGS. 3–4 of the drawings, or any one of a number of other different types of earring accessory designs. In each case, the earring accessory is preferably provided with a small attachment ring 7 at the upper end thereof to facilitate mounting of the earring accessories relative to the earring holder 1.

The earring holder 1 includes an earring holder body 9 which is generally oblong or elliptically shaped and also tapers from a lower end to an upper end thereof. Specifically, it will be seen that the earring holder body 9, as shown in FIGS. 3–4 of the drawings, has a generally oblong shape which tapers upwardly from a lower transverse end wall 11, that extends across the hollow earring holder body 9, to an upper end 13. The upper end 13 of the hollow earring holder body 9 is shown as being interconnected to a ball section 15 that extends between the earring holder body 9 and the curvilinearly shaped ear lobe hook 17, which may extend through a pierced ear lobe of a user, as will be appreciated. In lieu of the ball section 15, the upper end 13 of the hollow earring body holder 9 may be mounted to any suitably shaped and configured section for attachment to ear lobe hook 17 or any one of the ear fastening devices illustrated in FIGS. 5–7 of the drawings.

For purposes which will become apparent, the lower transverse end wall 11 of the hollow earring holder body 9 is concave upwardly or dished such as shown in FIGS. 3–4 of the drawings. The transversely extending end wall 11 of the hollow earring holder body 9 further includes a centrally located opening 19 for receiving and mounting a spring loaded earring support means 21 relative to the hollow earring holder body 9.

The spring loaded earring support means 21 is spring biased and pivotally mounted relative to the hollow earring holder body 9 between an open position, as shown in FIG. 4, for interchangeably receiving at least one of a variety of different earring accessories, 3, 5, etc., and a closed position, as shown in FIG. 3 of the drawings, for releasably securing the at least one earring accessory 3, 5, etc. relative to the hollow earring holder body 9.

More specifically, the spring loaded earring support means, generally designated 21, includes an elongated rod section 23 that extends through the opening 19 in the transverse end wall 11 so as to be mounted within the hollow earring holder body 9, as shown in FIGS. 3–4 of the drawings. An interconnected hook section is integrally attached to the elongated rod section 23 and includes a horizontal portion 25 extending substantially normal or perpendicular to the elongated rod section 23 and a semi-circular shaped hook portion 27 which extends from the horizontal portion 25 and terminates in a free end hook or tab portion 29 that is generally aligned with the horizontal portion 25.

A convolutely wound spring 31 is mounted about the elongated rod section 23 and is captured between an upper inner surface of the lower transverse end wall 11 and a transversely extending plate 33 mounted on the elongated rod section 23 adjacent a free end thereof.

With earring holder 1 constructed as described above, various earring accessories 3, 5, etc., may be interchangeably mounted relative to the earring holder 1, while the earring holder 1 remains attached to the ear lobe of a user. In order to permit this ready interchangeability, the hook section, including the semi-circular hook portion 27, is pulled away from a hollow earring holder body 9, as shown in FIG. 3, compressing the convolutely wound spring 31 between the transverse end wall 11 and the transversely extending plate 33 as the elongated rod section 23 is pulled through the opening 19 in the transverse end wall 11 of the hollow earring holder body 9. This will permit a user to mount any one of the earring accessories 3, 5, etc. relative to the earring holder 1, when the semi-circular shaped hook portion 27 is lowered to the dotted line position, as shown in FIG. 3 of the drawings.

Preferably, the earring holder 1 is also constructed to enable the spring loaded earring support means 21 to be pivotally mounted relative to the hollow earring holder body 9, as the elongated rod 23 is pulled downwardly away from the hollow earring holder body 9 and the upwardly concave or dished transverse end wall 11. This permits the hook section, including the semi-circular hook portion 27, to e disengaged from the upwardly concave or dished transverse end wall 11, such that the hook section, including the semi-circular hook portion 27, may be rotated or pivoted to the position shown in FIG. 4 of the drawing, where the hook section, including the semi-circular hook portion 27, is positioned generally transverse to the oblong-shaped hollow earring holder body 9. As will be appreciated, since the horizontal portion 25, including the semi-circular shaped hook portion 27, of the hook section, is larger than the transverse width of the oblong-shaped hollow earring holder body 9, the hook section, including the semi-circular shaped hook portion 27, will be maintained in an open and fixed position relative to the hollow earring holder body 9. In this open and fixed position, the free end 29 of the semi-circular hook portion 27 extends laterally outwardly beyond the oblong-shaped hollow earring holder body 9, enabling any one or combination of accessories 3, 5, etc. to be mounted relative to the semi-circular shaped hook portion 27 of the hook section. Because the hook section is maintained in an open and fixed position, as shown in FIG. 4 of the drawings, it will also be appreciated that a user of the earring holder 1 will not have to use speed or dexterity in mounting any one of the earring accessories 3, 5, etc. relative to the hook section.

Following interchangeable mounting of any one of the variety of different earring accessories 3, 5, etc. relative to the earring holder 1, as described above, the hook section is then returned to a generally aligned positioned relative to the upwardly concave or dished transverse end wall 11 of the hollow earring holder body 9 for releasably securing an earring accessory or accessories on the hook section. In this regard, it will be appreciated that the convolutely wound spring 31, mounted about the elongated rod section 23, is constructed to exert an upward force on the hook section, such that it will be moved into spring biased contact relative to the upwardly concave or dished transverse end wall 11. As seen in FIG. 3 of the drawings, the horizontal portion 25 and the free end hook or tab portion 29 of the hook section are shown as being generally received within the upwardly concaved or dished transverse end wall 11, for releasably securing various earring accessories 3, 5, etc. relative to the earring holder 1.

Figure 5:
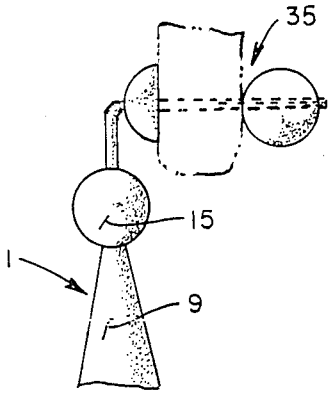
FIG. 5 is an enlarged fragmentary end elevational view illustrating one type of ear lobe fastening device that may be used with the earring holder of the present invention.
Figure 6:
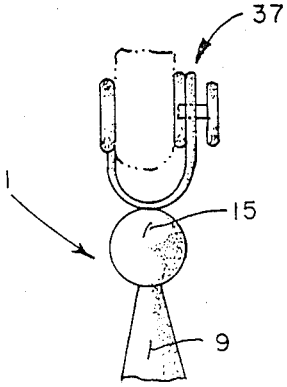
FIG. 6 is an enlarged fragmentary end elevational view of another type of lobe fastening device that may be used with the earring of the present invention.
Figure 7:
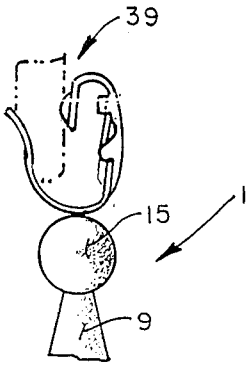
FIG. 7 is an enlarged fragmentary end elevational view of still another type of ear lobe fastening device that may be used with the earring holder of the present invention.

Various types of ear attachment devices may also be utilized with the earring holder 1 of the present invention. As shown in FIGS. 5–7 of the drawings, a post/-clutch ear fastening device 35 ay be connected to the ball section 15 at the upper end of the hollow earring holder body 9 as shown in FIG. 5; or screw clamp device 37, with a rotatable and adjustable ear pad mounted to a U-shaped clip, as shown in FIG. 6 may be employed; or a spring biased ear fastening clip 39, for releasably engaging an ear lobe as shown in FIG. 7, may be employed. These are representative examples of various ear attachment devices that may be operably associated with the earring holder 1 of the present invention for attaching the earring holder 1 to a user's ear lobe.

From the foregoing, it will be appreciated that the earring holder 1 of the present invention is constructed for interchangeably receiving at least one of a variety of different earring accessories 3, 5, etc. as may be desired. The configuration, shape and structural interrelationship of the hollow earring holder body 9 relative to the spring loaded earring support means 21 may be varied to suit the particular desire. For example, the shape of the hollow earring holder body 9 may be varied and the spring loaded earring support means may be suitably complementary configured for association with these other body shapes, as may be desired.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. An earring holder for interchangeably receiving at least one of a variety of different earring accessories and including:

an earring holder body;

spring loaded earring support means pivotally mounted at least at a lower end of said earring holder body between an open position where the spring loaded earring support means extends transverse to said earring holder body for interchangeably mounting at least one earring accessory and a closed position where the spring loaded earring support means is generally aligned with said earring holder body for releasably securing said at least one earring accessory in spring biased relationship to said earring holder body; and ear attachment means operably associated with said earring for attaching said earring holder to a user's ear.

2. The earring holder as defined in claim 1 wherein said earring holder body is hollow and said spring loaded earring support means extends at least partially within said earring holder body.

3. The earring holder as defined in claim 2 wherein said spring loaded earring support means includes an elongated rod section extending within said hollow earring holder body and a hook section extending outside said hollow earring holder body.

4. The earring holder as define in claim 3 and including a convolutely wound spring mounted about the elongated rod section of said spring loaded earring support means, said elongated rod section extending through a lower transverse end wall of said hollow earring holder body, and said convoluted wound spring being captured between the lower transverse end wall of said hollow earring holder body and a transversely extending plate mounted on said elongated rod section adjacent a free end thereof.

5. The earring holder as defined in claim 4 wherein the transverse end wall of said hollow earring holder body is upwardly concave, and the hook section of said spring loaded earring support means is biased by said convolutely wound spring into releasably secured engagement within the upwardly concave transverse end wall of said hollow earring holder body.

6. The earring holder as defined in claim 5 wherein the hollow earring holder body at least in the vicinity of said upwardly concave transverse end wall is generally oblong shaped, the elongated rod section of said spring loaded earring support means being pivotally mounted relative to an opening in said upwardly concave transverse end wall, and the hook section of said spring loaded earring support means being pivotally mounted between an open position which is generally transverse to said generally oblong shaped hollow earring holder body and a closed position in general alignment within said generally oblong-shaped hollow earring holder body.

7. The earring holder as defined in claim 6 wherein the hook section of said spring loaded earring support means is held in said open position by said convolutely wound spring to facilitate interchangeable mounting of earring accessories thereon.

8. The earring holder as defined in claim 7 wherein said hollow earring holder body has a generally oblong shape that also tapers inwardly from said transverse end wall to said ear attachment means.

9. The earring holder as defined in claim 8 wherein said ear attachment means includes a curvilinear ear hole hook connected to said hollow earring holder body at an end opposite from said upwardly concave transverse end wall.

10. The earring holder as defined in claim 8 wherein said ear attachment means includes an ear post and complementary releasable locking device, said ear post connected to said hollow earring holder body at an end opposite from said upwardly concave transverse end wall.

11. The earring holder as defined in claim 8 wherein said ear attachment means includes an adjustable clip adapted to be mounted relative to an ear lobe, said adjustable clip being connected to said hollow earring holder body at an end opposite from said upwardly concave transverse end wall.

12. The earring holder as defined in claim 8 wherein said adjustable clip includes a rotatably mounted adjustable ear pad mounted relative to a U-shaped clip adapted to be positioned over an ear lobe of a user.

13. The earring holder as defined in claim 11 wherein said adjustable clip includes a spring biased clip adapted to releasably engage an ear lobe of a user.

14. An earring holder for interchangeably receiving at least one of a variety of different earring accessories and including:

a hollow earring holder body having a generally oblong shape which tapers upwardly from a lower transverse end wall extending across said hollow earring holder body to an upper end;

an earring support mounted to said hollow earring holder body and including an elongated rod section extending through an opening in said transverse end wall for reception within said hollow earring holder body and an interconnected hook section attached to said elongated rod section and extending outside of said hollow earring holder body;

a convolutely wound spring mounted about said elongated rod section and being captured between the lower transverse end wall of said hollow earring holder body and a transversely extending plate mounted on said elongated rod section adjacent a free end thereof;

said hook section being pulled away from and pivoted generally transverse to said oblong-shaped hollow earring holder body to cause said convolutely wound spring to be compressed for holding said hook section in an open and fixed position by said oblong-shaped hollow earring holder body facilitating interchangeable mounting of earring accessories on said hook section, said hook section being returned to a generally aligned position relative to said transverse end wall for releasably securing at least one earring accessory on said hook section when spring biased into contact with said transverse end wall; and ear attachment means operably associated with said earring holder for attaching said earring to a user's ear.

15. The earring holder as defined in claim 14 wherein said transverse end wall also extends concave upwardly, and said hook section is at least partially received within said concave upwardly extending transverse end wall.

16. The earring holder as defined in claim 15 wherein said hook section is configured and dimensioned to extend to provide a free end hook portion that extends beyond the hollow earring holder body when the hook section is in said open and fixed position generally transverse to said oblong-shaped hollow earring holder body.

17. The earring holder as defined in claim 16 wherein said hook section includes a horizontal portion extending substantially perpendicular to said elongated rod section and a semi-circular shaped hook portion extending therefrom and terminating in a free end tab portion generally aligned with said horizontal portion.

* * * * *

UNITED STATES PATENT AND TRADEMARK OFFICE

CERTIFICATE OF CORRECTION

PATENT NO. : 4,869,078

DATED : September 26, 1989

INVENTOR(S) : Marijana T. Leith et al

It is certified that error appears in the above-identified patent and that said Letters Patent is hereby corrected as shown below:

Column 2, Line 4 is "in accordance with of the present" should be --in accordance with the teachings of the present invention--.

Column 2, Line 11 is "different accessories" should be --different earring accessories--.

Column 2, Line 15 is "one accessory thereon" should be --one earring accessory thereon--.

Column 2, Line 21 is "of lobe fastening" should be --of ear lobe fastening--.

Column 2, Line 23 is "the earring of" should be --the earring holder of--.

Column 3, Line 54 is "e disengaged" should be --be disengaged--

Column 4, Line 36 is "device 35 ay" should be --device 35 may--.

UNITED STATES PATENT AND TRADEMARK OFFICE

CERTIFICATE OF CORRECTION

PATENT NO. : 4,869,078

DATED : September 26, 1989

INVENTOR(S) : Marijana T. Leith et.al

It is certified that error appears in the above-identified patent and that said Letters Patent is hereby corrected as shown below:

Claim 4, Column 5, Line 30 is "as define" should be --as defined--.

Signed and Sealed this

Thirteenth Day of November, 1990

*Attest:*

HARRY F. MANBECK, JR.

*Attesting Officer*

*Commissioner of Patents and Trademarks*